US008152286B2

(12) United States Patent
Kawamura

(10) Patent No.: US 8,152,286 B2
(45) Date of Patent: Apr. 10, 2012

(54) INK SUPPLY DEVICE AND INKJET IMAGE RECORDING DEVICE

(75) Inventor: Hiroki Kawamura, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1138 days.

(21) Appl. No.: 11/965,260

(22) Filed: Dec. 27, 2007

(65) Prior Publication Data

US 2008/0158315 A1 Jul. 3, 2008

(30) Foreign Application Priority Data

Dec. 28, 2006 (JP) ..... 2006-354697

(51) Int. Cl.
*B41J 2/175* (2006.01)

(52) U.S. Cl. ..... 347/86; 222/35

(58) Field of Classification Search ..... 347/84–86, 347/94; 222/35

See application file for complete search history.

(56) References Cited

U.S. PATENT DOCUMENTS

| | | | | |
|---|---|---|---|---|
| 4,819,908 | A * | 4/1989 | Norkey | 251/149.6 |
| 4,911,203 | A * | 3/1990 | Garms | 137/614.04 |
| 7,182,446 | B2 | 2/2007 | Usui et al. | |
| 7,328,987 | B2 | 2/2008 | Katayama et al. | |
| 7,455,381 | B2 | 11/2008 | Koike et al. | |
| 7,455,398 | B2 | 11/2008 | Kanbe | |
| 7,597,433 | B2 * | 10/2009 | Tanahashi et al. | 347/86 |
| 2001/0020971 | A1 * | 9/2001 | Usui et al. | 347/86 |
| 2005/0088497 | A1 * | 4/2005 | Katayama et al. | 347/86 |
| 2005/0140749 | A1 * | 6/2005 | Usui et al. | 347/84 |
| 2005/0146577 | A1 * | 7/2005 | Sasaki et al. | 347/86 |
| 2006/0125888 | A1 * | 6/2006 | Kanbe | 347/86 |
| 2006/0158469 | A1 * | 7/2006 | Koike et al. | 347/7 |

FOREIGN PATENT DOCUMENTS

| | | | |
|---|---|---|---|
| JP | 2003300330 A | | 10/2003 |
| JP | 2005-125741 A | | 5/2005 |
| JP | 2005125741 A | * | 5/2005 |
| JP | 2005238576 A | | 9/2005 |
| JP | 2006015659 A | | 1/2006 |
| JP | 2006-167950 A | | 6/2006 |
| JP | 2006167950 A | * | 6/2006 |
| JP | 2006-192793 A | | 7/2006 |
| JP | 2006192793 A | * | 7/2006 |

OTHER PUBLICATIONS

Japanese Patent Office, Notice of Reasons for Rejection for Japanese Patent Application No. 2006-354697 (counterpart to above-captioned patent application), mailed Dec. 10, 2008.

* cited by examiner

*Primary Examiner* — Charlie Peng
*Assistant Examiner* — Peter Radkowski
(74) *Attorney, Agent, or Firm* — Baker Botts L.L.P.

(57) ABSTRACT

The present invention is directed to an ink supply device having an ink cartridge and a cartridge mount. The ink cartridge has an ink supply portion and an air intake portion. The cartridge mount has a first projection and a second projection. When the ink cartridge is inserted into the cartridge mount, the first projection opens the ink supply portion, and the second projection opens the air intake portion. The second projection has an operating piece, a guide path for receiving the operating piece, and a spring for exerting force on the operating piece. The second projection contacts the air supply portion prior to the first projection contacting the ink supply portion, and the guide path receives the operating piece after the second projection contacts the air supply portion.

16 Claims, 6 Drawing Sheets

INK SUPPLY DEVICE AND INKJET IMAGE RECORDING DEVICE

CROSS-REFERENCE TO RELATED APPLICATION

The present invention claims priority from Japanese Patent Application Publication No. JP-2006-354697, which was filed on Dec. 28, 2006, the disclosure of which is incorporated herein by reference in its entirety.

BACKGROUND OF THE INVENTION

1. Field of the Invention

The present invention relates to an ink supply device capable of removably mounting an ink cartridge and, more specifically, to an ink supply device capable of performing a reliable ink supply operation from the ink cartridge when the mounted ink cartridge is opened to the outside atmosphere. The present invention also pertains to an inkjet image recording device having the above-described ink supply device.

2. Description of Related Art

In general, a known inkjet recording device records an image on a conveyed recording medium by ejecting ink drops from a recording head mounted on a carriage. The carriage is movable in a main scan direction perpendicular to the direction of conveyance. Ink is stored in advance in a removable cartridge type ink tank, e.g., an ink cartridge, and supplied from the ink cartridge to the recording head. Ink cartridges are generally divided broadly into on-carriage types and off-carriage types, depending on the installation position of the cartridge in the inkjet recording device. The on-carriage type has a case having a mounting portion for removably mounting an ink cartridge provided on a carriage which is movable, as described above. Ink is supplied from the ink cartridge, mounted, and held within the mounting portion of the case to a recording head. In contrast, the off-carriage type has a case having a mounting portion for removably mounting an ink cartridge provided in a housing of an inkjet recording device at a location other than the movable carriage. Ink is supplied from the ink cartridge to a recording head through an ink supply tube.

Typically, in the known ink cartridge, if gas is dissolved in the ink to be supplied to the ink reservoir, the gas in the ink forms bubbles in the recording head. These bubbles may cause the nozzles to clog during recording, which may deteriorate printing performance. In order to prevent this, ink is supplied to the ink reservoir in a deaerated state. To maintain this state, the inside of the ink reservoir is maintained in a negative, or reduced below atmospheric, pressure state.

In both the known on-carriage type and the known off-carriage type, when the ink cartridge is set within the mounting portion, if the ink supply valve is opened first, air and ink accumulated in the mounting portion flows back to the ink reservoir, because the inside of the ink reservoir is in a negative pressure state. This may cause meniscus formed at a nozzle of the recording head to break. Known inkjet printer systems include an ink cartridge and a mounting portion provided in a housing. In known inkjet printer systems, the ink cartridge includes an ink reservoir, an ink supply valve for supplying ink, and an air communication recess covered with a sealing film to be torn for communication of the ink reservoir with the atmospheric air. Known inkjet printer systems feature an air communication protrusion for tearing the sealing film, or a hollow air intake for pushing the air communication valve to open it to the atmospheric air, and an ink intake to be connected to the ink supply valve for drawing out ink from the ink reservoir. In known inkjet printer systems, these are installed on the base portion of the mounting portion, upright, parallel, and extending in a direction opposite to the insertion direction of the ink cartridge. In known inkjet printer systems, the air communication protrusion is larger than that of the ink intake, such that the ink cartridge is opened to the atmospheric air before ink starts to flow from the ink cartridge.

Nevertheless, in this known inkjet system, the difference in protrusion amount between the air communication protrusion or the air intake and the ink intake may be small, which may lead to complications in operation. If the operation speed for inserting the ink cartridge into the mounting portion is rapid, the time between the introduction of air into the air communication valve and the connection of the ink intake to the ink supply valve becomes substantially zero, because there is little time difference therebetween. Thereupon, although the ink reservoir is still in a negative pressure state, the ink supply valve is opened, and as described above, air or ink accumulated in the mounting portion flows back into the ink reservoir. This may cause a breakage of the meniscus in the nozzle of the recording head and degrade printing performance.

Further, in a known inkjet system, if the ink cartridge is inserted at an angle with respect to the mounting portion, the connection of the ink intake to the ink supply valve may be established before opening of the air communication portion, so that the ink reservoir is may be placed in a negative pressure state. Thereupon, under an affection of the negative pressure within the ink cartridge, ink in the recording head flows back into the ink cartridge via the ink supply valve, and the meniscus in the nozzle of the recording head may be broken. This may result in a large amount of air being accumulated within the recording head, which may cause a defective ink supply operation.

For the purpose of solving the above-described problems, if an air communication protrusion is lengthened to increase the protrusion amount thereof, the air communication protrusion may be deformed or broken when the ink cartridge is inserted with the posture inclined, or if the ink cartridge is accidentally dropped. Furthermore, if the air communication protrusion is lengthened, the ink cartridge is required to have a large space for accommodating the long air communication protrusion when the ink cartridge is mounted on the mounting portion. As a result, because the size of the ink cartridge itself may increase, the size of the ink supply also may increase, or the capacity to store ink in the ink cartridge may decrease.

SUMMARY OF THE INVENTION

It is an object of the present invention to provide an ink supply device and an inkjet image recording device including an ink supply device, in which a reliable ink supply operation is performed by bringing a pressure inside an ink cartridge close to the atmospheric pressure before the ink supply is started, regardless of the mounting speed of the ink cartridge.

According to an embodiment of the present invention, an ink supply device comprises an ink cartridge, and the ink cartridge comprises an ink supply portion configured to supply ink from an interior of an ink chamber to an exterior of the ink chamber via an ink supply opening formed therethrough, an air intake portion configured to draw air from the exterior of the ink chamber into the interior of the ink chamber via an air intake opening formed therethrough, and a main body comprising a cartridge mount configured to removably receive the ink cartridge when the ink cartridge is inserted in an insertion direction. The cartridge mount comprises a first projecting member configured to open the ink supply opening, and a second projecting member configured to removably receive the ink cartridge when the ink cartridge is inserted in an insertion direction. The second projecting member comprises an operating body, a guide member configured to receive the operating body therein, and an urging member configured to urge the operating body away from the guide member in a direction opposite the insertion direction, wherein the operating body is configured to open the air intake opening and to move in the insertion direction into the guide member after opening the air intake opening.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF THE EMBODIMENTS

An embodiment according to the present invention will be described in detail with reference to the appended drawings.

According to one embodiment of the present invention, the image recording device may be a multi-function device ("MFD"). The multi-function device may include one or more of a printer function, a copy function, a scanner function, and a facsimile function. The multi-function device may be connected to a computer (not shown), and may record an image or text on a recording medium, e.g., a recording sheet. The image or text may be based mainly on image data or text data transmitted from the computer. The multi-function device also may be connected to external equipment, e.g., a digital camera or other image capturing devices, to thereby record image data outputted from the external equipment onto a recording medium.

Figure 1:
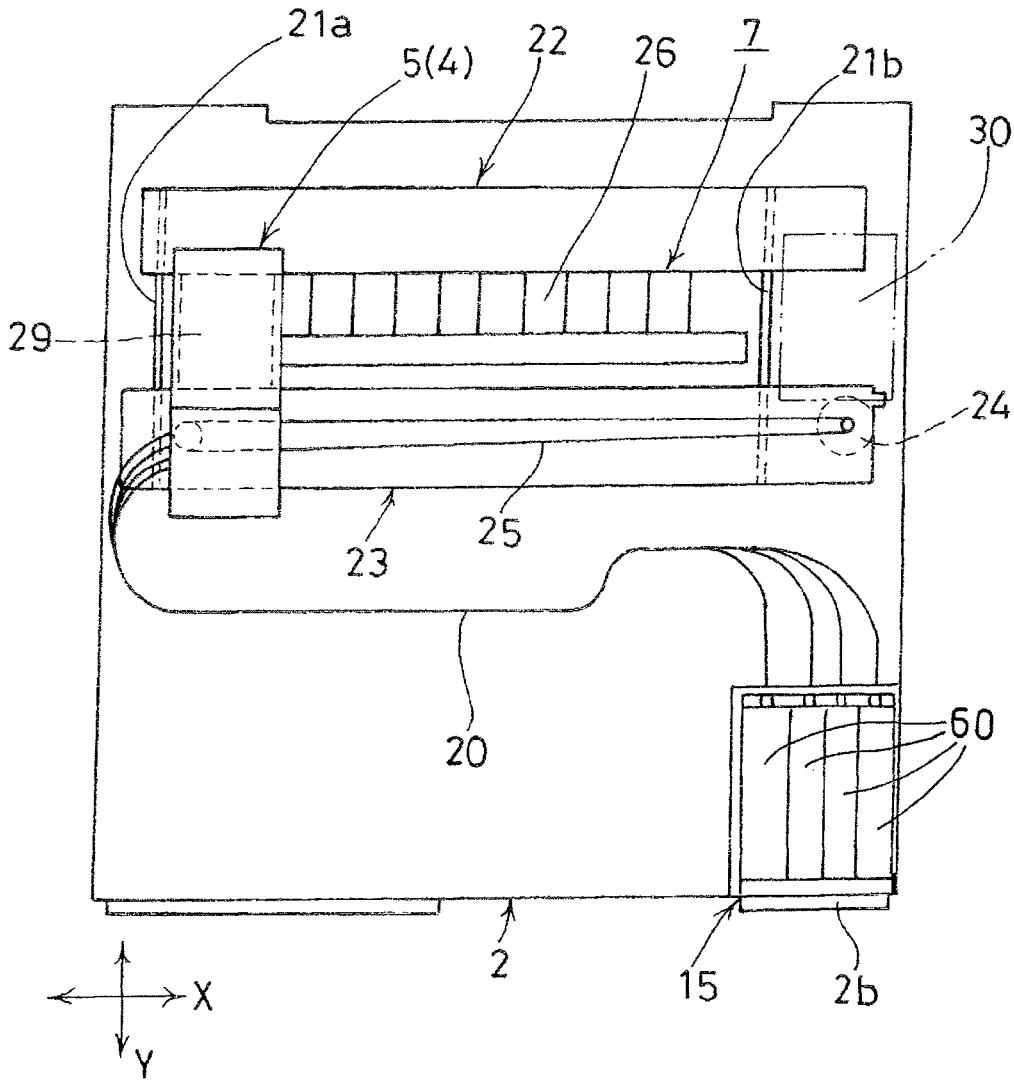
FIG. 1 is a plan view of a multi-function device according to an embodiment of the present invention.

FIG. 1 shows a printer, e.g., a recording unit 7, which may be provided at a lower portion of a device casing 2. Device casing 2 may be constructed from any suitable material, e.g., a synthetic resin. On the bottom of device casing 2, a sheet cassette may be provided in a mounting space, e.g., a sheet cassette mount. The sheet cassette may be substantially horizontally oriented, and may be capable of being inserted into and removed from an insertion port, which may be opened at a front side of device casing 2. An image reader (not shown) which may read documents in certain printer functions, e.g., the copy function or facsimile function, may be arranged on an upper portion of the device casing 2. An operation panel (not shown), which may include various operation buttons and/or a liquid crystal display, may be positioned on the upper side of device casing 2, in front of the image reader.

A cartridge mounting device 15, described in more detail further herein, may be incorporated on the front right side of device casing 2. At the front end of device casing 2, the front of cartridge mounting device 15 may be covered by a lid member 2*b*. Lid member 2*b* may be opened and closed by being turned upward and downward, respectively, via a hinge at its lower end.

Recording media, e.g., sheets, may be stacked in the sheet cassette, and may be separately conveyed one after another, by one or both of a feed roller (not shown) and an inclined separation plate (not shown). A separated sheet P may be fed to a recording unit 7, provided behind and above the sheet cassette via a paper-feeding path extending upwardly and horizontally. The paper-feeding path may be U-turn shaped. Recording unit 7 also may include a movable carriage 5 equipped with an inkjet recording head 4 for implementing the printer function. Movable carriage 5 may move in a reciprocating motion.

Figure 2:
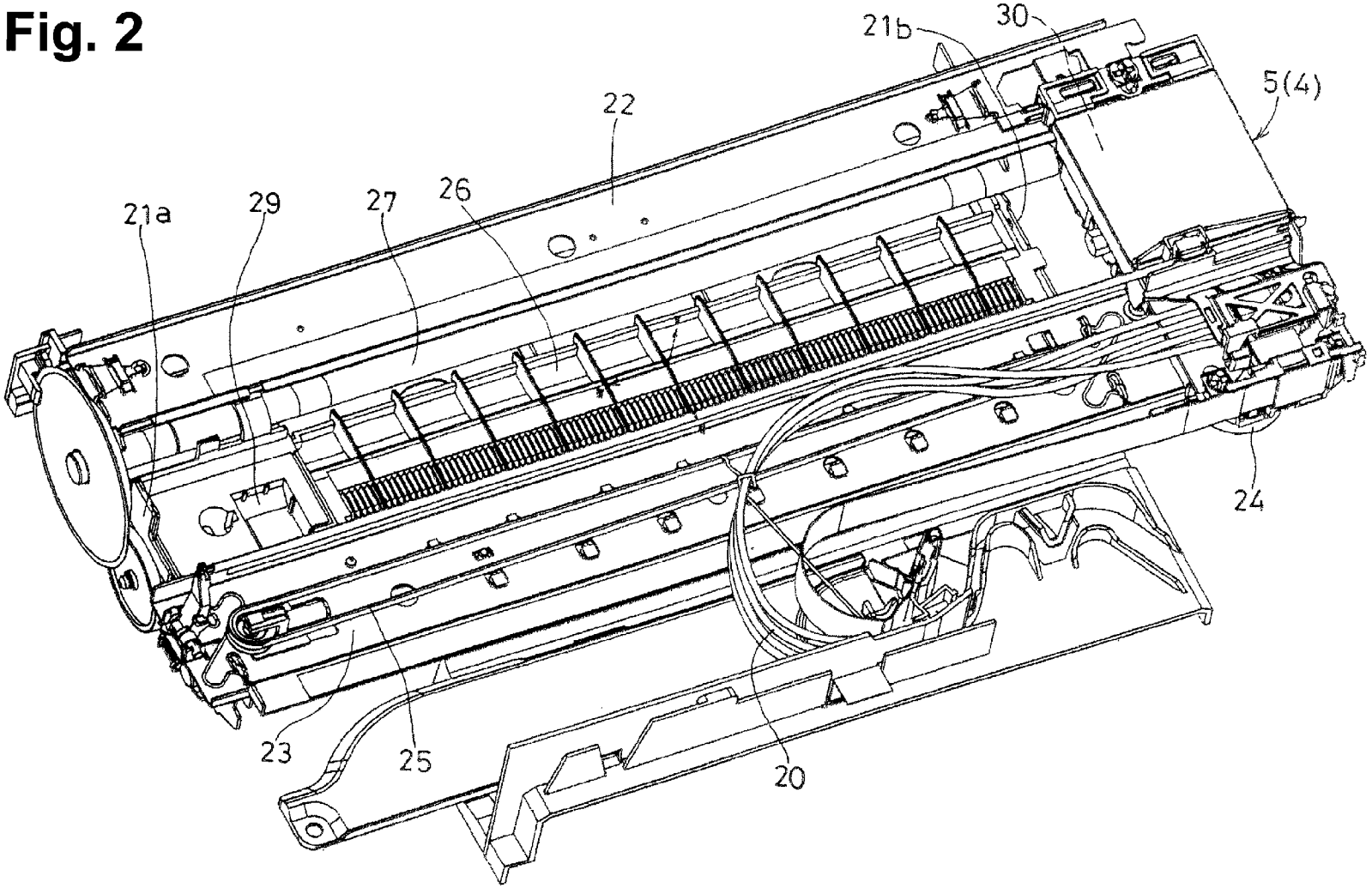
FIG. 2 is a perspective view of a recording unit according to an embodiment of the present invention.

As shown in FIGS. 1 and 2, recording unit 7 may be supported by a pair of plates, right side plate 21*a*, and left side plate 21*b*, of a main frame 21. Main frame 21 may have a box shape, with an opening at its upper face. A first guide member 22 and a second guide member 23 each may have a plate shape, with a width direction longer than a length direction, and may extend in the X-axis direction (main scanning direction). A carriage 5 may slidably move in a reciprocating motion over the guide members 22 and 23. A timing belt 25, which may be configured to loop around repeatedly, e.g., as an endless belt, may be wound around a pulley and may be located substantially at an upper surface of second guide member 23, in parallel to the upper surface. A carriage (CR) motor 24 may drive timing belt 25, which may cause carriage 5, equipped with the recording head 4, to reciprocate. Although in this embodiment, carriage motor 24 may be a DC motor, other motors, e.g., a stepping motor, may be used in other embodiments. A plate-shaped platen 26 may support sheet P while sheet P is conveyed at a lower face side of recording head 4. A tape scale (not shown), which is a component of an optical linear encoder for detecting the position and movement speed of the carriage 5 in the X-axis direction (main scanning direction), may be arranged to extend along the main scanning direction.

An ink receiver 29 and a maintenance unit 30 may be positioned outside the width, e.g., the short side, of sheet P to be conveyed. Ink receiver 29 may be located at one end of sheet P, e.g., at a region close to left side plate 21*a* in FIGS. 1 and 2. Maintenance unit 30 may be located at the other end of sheet P, e.g., at a region close to right side plate 21*b* in FIGS. 1 and 2. Recording head 4 regularly may discharge ink at a flushing position provided at the ink receiver 29, in order to prevent nozzle clogging during a recording operation. Ink receiver 29 may receive the discharged ink. When recording head 4 moves into a standby position, maintenance unit 30 may perform recovery processes for recording head 4, by selectively drawing in ink of each color, and by removing bubbles in a buffer tank (not shown) on recording head 4. Maintenance unit 30 also may include a wiper (not shown) provided to clean the nozzle face of recording head 4 when carriage 5 is moved from maintenance unit 30 to an image recording region.

Cartridge mounting device 15 may include a mounting case 60, described in more detail further herein, capable of mounting one or more ink cartridges 40. In an embodiment of the invention, ink cartridges 40 are mounted in a line, e.g., along the X-axis direction. Ink cartridges 40 may store a plurality of, e.g., four, colors of inks for full-color recording. Each of ink cartridges 40 may stores one of the inks of a plurality of, e.g., four, colors, e.g., black (BK), cyan (C), magenta (M) and yellow (Y). Each ink cartridge further may have an approximately rectangular parallelepiped shape, and may have a small area in plan view plane, and a large height. Cartridge mounting device 15 may include doors 61 configured for opening and closing openings at the front of the mounting case 15. Doors 61 may be opened to allow ink cartridges 60 to be removably inserted into mounting case 60.

Figure 3:
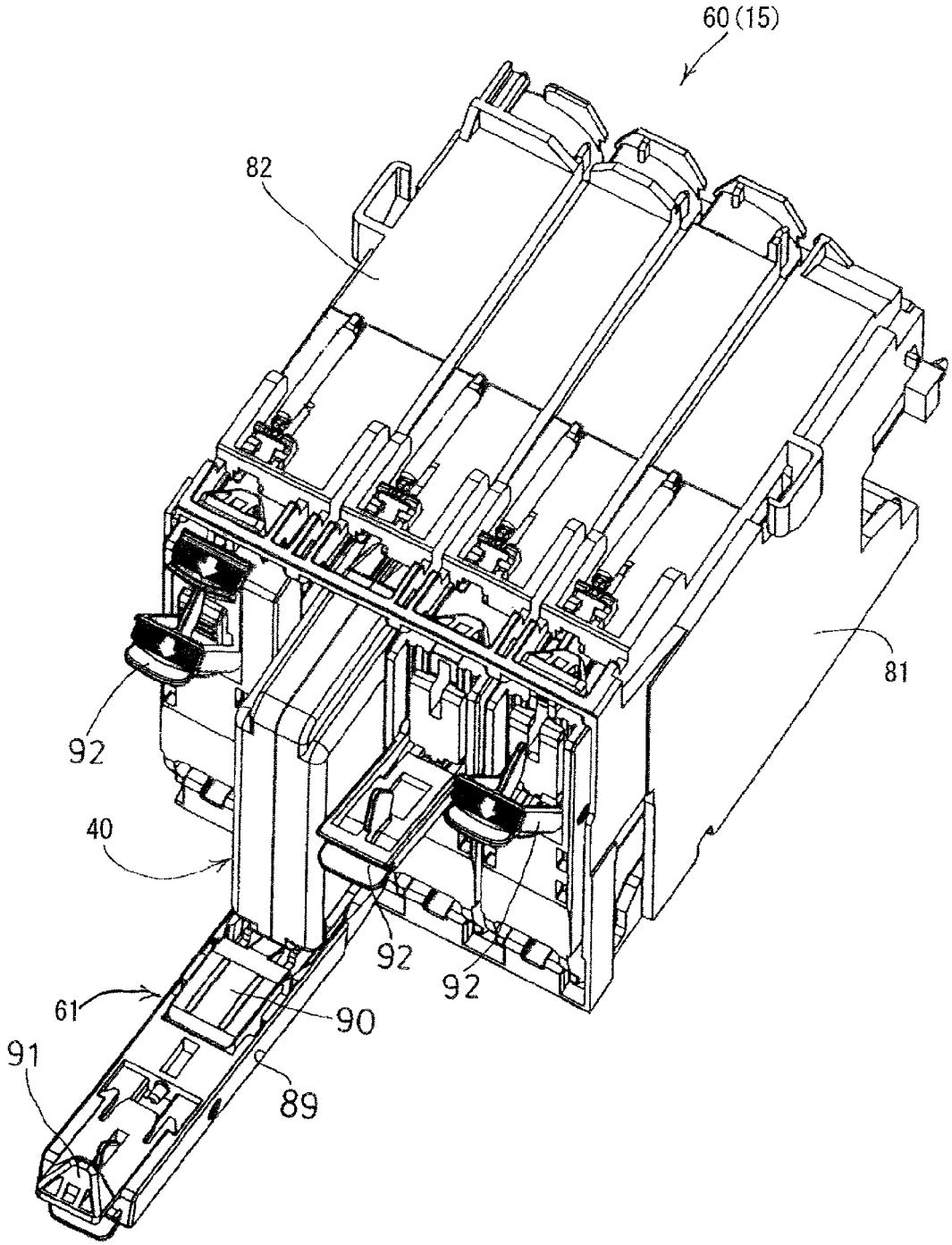
FIG. 3 is a perspective view of a cartridge mounting device according to an embodiment of the present invention

Ink cartridges 40 each may include a cartridge body 41, which may comprise any appropriate material, e.g., a synthetic resin, and ink may be contained in the cartridge body 41. In an embodiment, cartridge mounting device 15 may be configured to accommodate four ink cartridges 40, e.g., inks of cyan, magenta, yellow, and black colors may be stored in respective ink cartridges 40. However, regarding the structures of respective ink cartridges 40, the ink cartridge for storing black ink may be slightly larger in the thickness direction, e.g., the right to left direction when viewing the ink cartridges as shown in FIG. 3, than the other ink cartridges. Ink cartridges 40 for storing color inks other than the black color ink all may have substantially the same structure.

Figure 4:
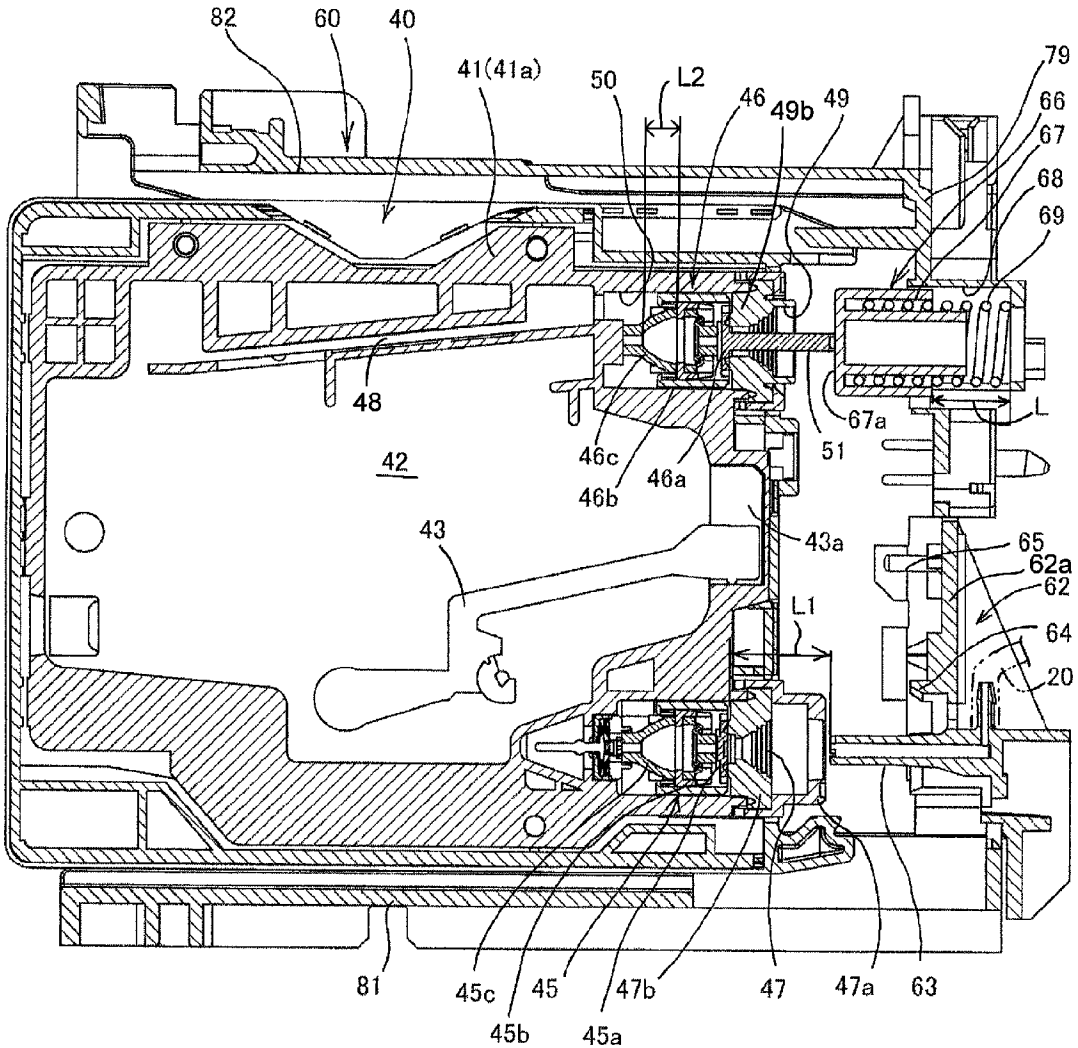
FIG. 4 is a sectional side view illustrating the positional relationship among an air communication valve, an operating piece, and an operating body when an ink cartridge is first inserted into a mounting case, according to an embodiment of the present invention.

As shown in FIGS. 3 and 4, cartridge body 41 may have a thin rectangular parallelepiped shape as a whole, and an ink accommodating space may be defined therein. Cartridge body 41 may include a frame 41*a* having reinforcing ribs provided on its inner periphery, and also may include an ink chamber 42 serving as an ink reservoir. Ink chamber 42 may be enclosed by films (not shown) that are bonded to opposing wide faces of frame 41*a*, in parallel to the wide faces. Frame 41*a* and ink chamber 42 may be enclosed by a pair of tray-shaped members, which may be joined with each other by an appropriate fixing method, e.g., welding.

An air communication valve 46 and an ink supply valve 45 may be arranged in the cartridge body 41, and may be in fluid communication with ink chamber 42. An air inlet 49 may be configured to be in fluid communication with the air communication valve, and an ink supply port 47 may be configured to be in fluid communication with the ink supply valve. Both air inlet 49 and ink supply port 47 may be conical holes that may be open in an end face of frame 41*a*. That end face may be located on the downstream side in the insertion direction of ink cartridge 40 to mounting case 60. Air inlet 49 may open in a direction which faces the deep rear face of mounting case 60, at a position higher than the ink supply port 47. This configuration may allow air to accumulate in ink chamber 42 at a position that is distant from and higher than ink supply valve 45, when air communication valve 46 is opened.

A valve body 45*a*, a valve holding frame 45*b*, and a substantially conical-shaped elastic member 45*c* of the ink supply valve 45 may be arranged in a valve chamber configured to be in fluid communication with ink supply port 47, and also may be arranged in a line, so as to be capable of moving forward and backward. Upon setting ink cartridge 40 into mounting case 60, valve holding frame 45*b* may be pushed by ink intake 63 that protrudes from a connecting body 62, which will be described in more detail further herein. Valve body 45*a* may be urged by an urging force of the elastic member 45*c*. As a result of ink intake 63 pushing valve holding frame 45*b*, valve body 45*a* may move against the urging force of elastic member 45*c*, and may depart from a valve seat. Elastic member 45*c* may be made of any suitable material, e.g., rubber. The valve seat may be an inner end face of a member 47*b* defining the ink supply port 47, and when member 47*b* is opened, ink in ink chamber 42 may be supplied to the recording head via ink intake 63. A cylindrical cap 47*a* protrudes outward from ink supply port 47.

A valve body 46*a*, a valve holding frame 46*b*, and a substantially conical-shaped elastic member 46*c* of air communication valve 46 are arranged in an air intake chamber 50 configured to be in fluid communication with air inlet 49, and also may be arranged in a line, so as to be capable of moving forward and backward. A round shaft-shaped operating piece 51 may be formed integrally with the valve body 46*a*, such that operating piece 51 may protrude outward from air inlet 49. A valve seat for the valve body 46*a* may be provided on an inner end face of a member 49*b* defining the air inlet 49. Operating piece 51 of air communication valve 46 may protrude sideways, e.g., substantially horizontally, in parallel to the insertion direction of ink cartridge 40.

Arcuate guide ribs 64 may be formed in parallel to the insertion direction of the ink cartridge 40, and may protrude outward from the surface of mounting case 60 towards ink cartridge 40. Arcuate guide ribs may be provided at a lower side of the surface of a vertical plate 62*a* of connecting body 62 of mounting case 60, at a position corresponding to the height of the cap 47*a* of the ink supply valve 45. Arcuate ribs 64 may be fitted to the outer periphery of cap 47*a* and may guide the ink cartridge 40 during insertion. When ink cartridge 40 is set in an ink cartridge mount of mounting case 60, a cylindrical ink intake 63 provided at the deep rear face of the mounting case 60 may be connected to ink supply valve 45

Figure 5:
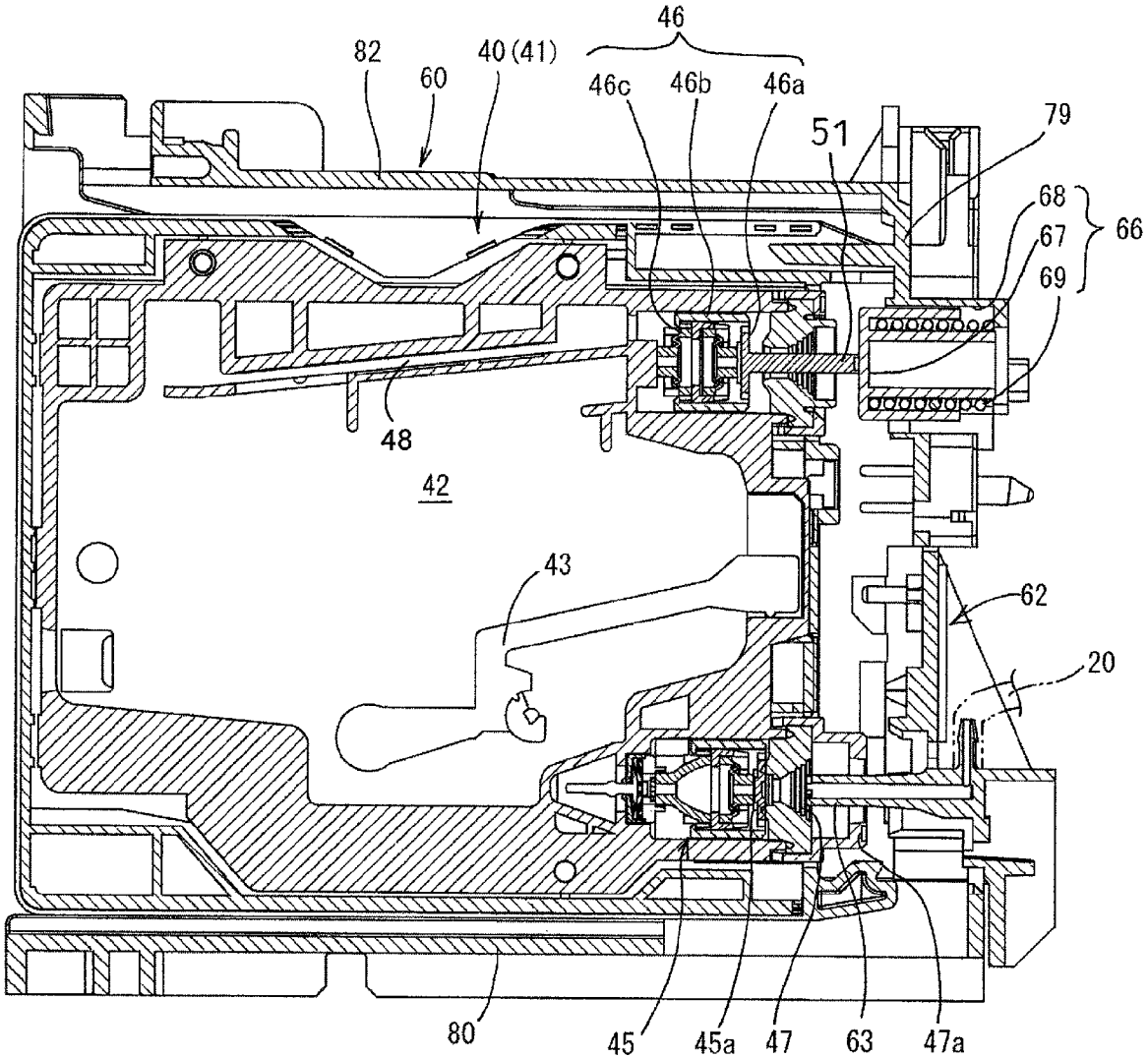
FIG. 5 is a sectional side view illustrating the positional relationship among the air communication valve, the operating piece, and the operating body when the air communication valve is open to the outside atmosphere, according to an embodiment of the present invention.
Figure 6:
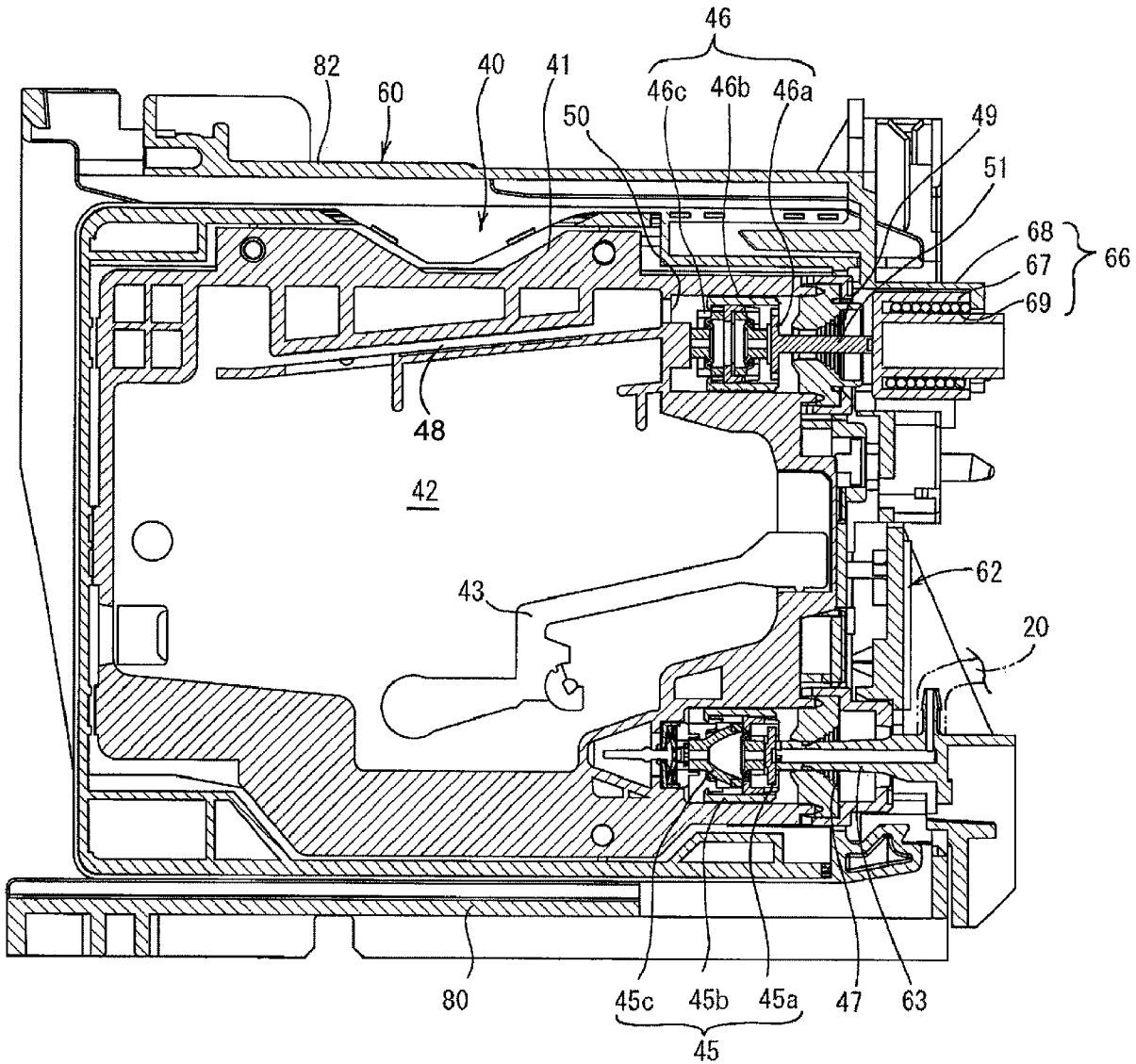
FIG. 6 is a sectional side view showing the positional relationship among the air communication valve, the operating piece, the operating body, an ink supply valve, and an ink intake when ink is being supplied, according to an embodiment of the present invention.

The ink in ink cartridge 40 may be supplied to recording head 4 via ink intake 63 and ink tube 20. A detected portion 43*a* may be provided at the back face of the cartridge body 41, and may be used for detecting the ink level in ink cartridge 40. Detected member 43 moves in an upward or downward direction based on the amount of ink remaining in ink cartridge 40. An ink level sensor, e.g., a photo interrupter, may be provided at connecting body 62 for constant monitoring of the ink liquid level. When ink cartridge 40 is set in the cartridge mount of the mounting case 60, ink level sensor 65 may be aligned in close proximity to ink cartridge 60, and may detect the presence or absence of detected portion 43*a* of detected body 43. As shown in FIGS. 4, 5, and 6, an operating member 66 for opening air communication valve 46 may be provided in connecting body 62, and mounted to the rear end of mounting case 60, at a position corresponding to the height of operating piece 51 of air communication valve 46 in a corresponding ink cartridge 40.

When ink cartridge 40 is inserted into cartridge mount 40, operating member 66 may be configured such that the air communication valve 46 is opened at a time earlier than the time at which ink supply valve 45 begins supplying ink toward the direction of ink intake 63. Operating member 66 may include an operating body 67, a guide path, e.g., a cylindrical guide chamber 68, and a compression coil spring 69 disposed in the guide path 68. Operating body 67 may function to abut against operating piece 51 of air communication valve 46 to open the air communication valve 46. Guide path 68 may be configured to accommodate operating body 67 therein, and to allow operating body 67 to move forward and backward. Compression coil spring 69 may serve as an urging member for urging operating body 67 in the valve-opening direction.

In a state where ink cartridge 40 is not located in the mounting case 60, an urging force of compressive coil spring 69 may urge operating body 67, which may cause operating body 69 to protrude outward towards the open face of mounting case 60 by a distance L. When pushed, operating body 67 may be capable of moving distance L along the guide path 68 towards connecting body 62. The urging force of compressive coil spring 69 may be configured to be larger than the elastic force of elastic member 46*c*, e.g., i.e., the valve-closing force of valve body 46*a*, of air communication valve 46. Therefore, in an embodiment of the invention, air communication valve 46 may be opened before operating body 67 begins moving.

As shown in FIG. 4, when ink cartridge 40 is inserted into the mounting case 60, and the rear end face of operating piece 51 abuts front end face 67*a* of operating body 67, air communication valve 46 may be in an opening start position. In this state, ink intake 63 may not have been fitted into cap 47*a*, and the tip of ink intake 63 may be located apart from valve body 45*a* of ink supply valve 45 by a distance L1. In an embodiment of the invention, distance L1 may be greater than distance L.

Next, as shown in FIG. 5, when ink cartridge 40 may be further inserted into mounting case 60, operating piece 51 may push against the elastic force of the elastic member 46*c*, and may push valve body 46*a* into the valve-opening state. After the valve body 46*a* has been opened and elastic member 46 has been compressed by a distance L2, e.g., elastic member 46 is in a fully compressed state, the operating body 67 may start moving in a direction away from ink cartridge 40, against the urging force of compressive coil spring 69. When valve body 46*a* is opened, the tip of ink intake 63 has been inserted into the cap 47*a*, but ink intake 63 may not have reached valve body 45*a* of ink supply valve 45. When valve body 46*a* is opened within a short time after contact is made between operating piece 51 and operating body 67, air from outside the ink chamber may be introduced into ink chamber 42 of ink cartridge 40, and the pressure in ink chamber 42 may approach or become equal to the exterior atmospheric pressure.

As shown in FIGS. 5 and 6, when ink cartridge 40 is still further inserted into mounting case 60, operating body 67 of operating member 66 moves still further in a direction away from ink cartridge 40, and may contact the rear end of guide path 68. When operating body 67 contacts the rear end of guide path 68, operating body 67 cannot move any further. Additionally, in this state, operating body 67 keeps the valve body open. By the time operating member 67 has finished moving in a direction away from ink cartridge 40, ink intake 63 has pushed valve body 45*a* of ink supply valve 45, which may open ink supply valve 45. Thereby, the ink in ink cartridge 40 may begin flowing to inkjet recording head 4 via ink tube 20, which may be connected to a connection portion of ink intake 63.

As described above, because distance L1 may be set to be larger than distance L (L<L1), a sufficient time lag may be occur after valve body 46*a* of air communication valve 46 has been opened, and before valve body 45*a* of ink supply valve 45 is opened. In addition, even when operating piece 51 pushes operating body 67 and moves the operating body 67 by the entire distance L before valve body 46*a* of air communication valve 46 is opened, valve body 45*a* of ink supply valve 45 may not be opened, either. Furthermore, the distance L1 may be configured to be smaller than the total of the distance L and the distance L2 (L1<L+L2). Therefore, valve body 45*a* of ink supply valve 45 may be opened by the time elastic member 46*c* reaches a state of complete compression, and operating body 67 may move the complete distance after valve body 46*a* of air communication valve 46 has been opened.

Thus, ink flow from the ink chamber 42 to the ink intake 63 may begin with a sufficient time lapse after ink chamber 42 is placed in fluid communication with the air from outside the ink chamber. In an embodiment, as described above, the operating body 67 begins moving after the opening of valve body 45*a* and the complete compression of elastic member 46*c*. Nevertheless, in other embodiments, operating body 67 may begin moving while opening valve body 45*a*.

Air communication valve 46 may remain open in a state in which ink chamber 42 begins to supply ink from ink chamber 42 of ink cartridge 40 in the direction of ink intake 63, via ink supply valve 45. When such a construction of operating member 66 is used, operating body 67 may be pressed by compressive coil spring 69 serving as an urging member. In this embodiment, an operation for pushing in ink cartridge 40 against the pressing force may be required. Therefore, a user may not insert ink cartridge 40 into mounting case 60 at an excessive speed. This produces a significant effect of reliably reducing the likelihood that ink supply valve 45 is opened with ink chamber 42 in a negative pressure state.

If the user applies too much force when inserting ink cartridge 40 into the mounting case 60, ink supply valve 45 may be opened with the ink chamber 42 being in a negative pressure state, or with the ink chamber 42 not yet sufficiently returned to the atmospheric pressure. In an embodiment, the pressure in ink chamber 42 may be maintained at the atmospheric pressure while preventing the evaporation of the ink in the ink chamber 42. In ink cartridge 40, ink that contains bubbles may exist in an air communication passage 48, which may be a minute space allowing air communication valve 46 to be in fluid communication with ink chamber 42 of ink cartridge 40. In such an embodiment, even if air communication valve 46 is opened, a negative pressure in the ink chamber 42 may approach the atmospheric pressure only in a gradual manner.

As shown in FIGS. 3 and 4, the mounting case 60 may include a bottom plate 80, a pair of side plates 81, installed upright on both right and left sides of bottom plate 80, a top plate 82, arranged so as to bridge the side plates 81, and a rear plate 79 provided adjacent to the top plate 82, to connect the right and left side plates 81. Moreover, mounting case 60 may have a front opening, and may have walls therein which may define cartridge mounts, and each cartridge mount may be suitable for mounting and holding an ink cartridge 40.

As shown in FIG. 3, at the front opening of mounting case 60, doors 61 may each correspond to one of the cartridge mounts, and ink cartridges 40 each may be inserted and removed from a respective cartridge mount, from the front side through the front opening. Door 61 may be made of any suitable material, e.g., a synthetic resin, and may be rotatable upward and downward, via a horizontal shaft formed at its lower end, on a front lower end of mounting case 60. Door 61 may include a holding member 90, a lock member 91, and an unlock lever 92, each of which may be constructed of any suitable material, e.g., a resin. As shown in FIG. 3, door 61 may be configured to change between a closed position for closing the front opening and an open position for opening the front opening. When door 61 is in the closed position, ink cartridge 40 may be reliably held in the cartridge mount. When door 61 takes the opening position, ink cartridge 40 may be easily inserted into and removed from the cartridge mount. During shipment and use, ink supply valve 45 and ink intake 63 may be hermetically sealed with each other.

In another embodiment of the invention, the opening of mounting case 60 of cartridge mounting device 15 may be provided on the top of mounting case 60, to open upward, and ink intake 63 may be provided on the bottom of mounting case 60. In this case, ink cartridge 40, with the above-described construction, may be inserted from above, and operating member 66 may be provided at the bottom of mounting case 60. Further, the present invention may be applied to both off-carriage and on-carriage types of ink supply devices. While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the following claims.

What is claimed is:

1. An ink supply device comprising:

an ink cartridge comprising:

a casing;

an ink chamber housed in the casing and configured to store ink therein;

an ink valve mechanism comprising an ink valve configured, when opened, to supply ink from an interior of an ink chamber to an exterior of the ink chamber; and an air valve mechanism comprising an air valve, a particular elastic member configured to selectively close the air valve, and a cartridge-side projecting member projecting from the casing and configured to move relative to the casing, wherein the air valve is configured, when opened, to draw air from the exterior of the ink chamber into the interior of the ink chambers;

a main body comprising a cartridge mount configured to removably receive the ink cartridge when the ink cartridge is inserted in an insertion direction, wherein the cartridge mount comprises:

a first projecting member configured to open the ink valve when the ink cartridge is inserted into the cartridge mount; and a second projecting member comprising an operating body and a further elastic member configured to be deformed such that the operating body retracts in the insertion direction, wherein when the ink cartridge is inserted into the cartridge mount and reaches a first position relative to the cartridge mount, the cartridge-side projecting member comes into contact with the operating body of the second projecting member, wherein when the ink cartridge is further inserted from the first position to a second position relative to the cartridge mount, the cartridge-side projecting member receives a force from the operating body of the second projecting member and moves relative to the casing of the ink cartridge in the direction opposite the insertion direction, wherein when the ink cartridge reaches the second position, the particular elastic member of the air valve mechanism is deformed and the air valve is opened as a result of the movement of the cartridge-side projecting member, and wherein when the ink cartridge is fully inserted to a third position from the second position relative to the cartridge mount, the air valve is kept open and the operating body retracts in the insertion direction by being pressed by the cartridge-side projecting member.

2. The ink supply device of claim 1, wherein the ink valve and the air valve are configured to be opened by the first projecting member and the second projecting member, respectively, when the ink cartridge is inserted into the cartridge mount, and the ink valve and the air valve are configured to be closed when the ink cartridge is removed from the cartridge mount.

3. The ink supply device of claim 1, wherein the first projecting member is configured to have a hollow cylindrical shape protruding away from the cartridge mount in a direction opposite the insertion direction.

4. The ink supply device according to claim 1, wherein an end of the first projecting member is configured to be a particular distance away from the ink valve when the ink cartridge is in the first position relative to the cartridge mount.

5. The ink supply device of claim 4, wherein the operating body is configured to retract in the insertion direction for up to a further distance from when the ink cartridge is in the first position to when the ink cartridge is in the third position.

6. The ink supply device of claim 5, wherein the particular distance is greater than the further distance.

7. The ink supply device of claim 5, wherein the particular elastic member of the air valve mechanism is configured to apply a force to the air valve in the insertion direction, and wherein the particular elastic member is configured to be compressed up to a third distance in the direction opposite the insertion direction when the cartridge-side projecting member receives the force from the operating body.

8. The ink supply device of claim 7, wherein the particular distance is less than the total of the further distance and the third distance.

9. The ink supply device of claim 1, wherein the cartridge-side projecting member is integrally formed with the air valve.

10. The ink supply device of claim 1, wherein the cartridge mount is disposed in a mounting case positioned on the main body of the ink supply device, and the mounting case comprises a door member configured to open and close, wherein when the door member is in a closed position, the door member holds the ink cartridge in the cartridge mount.

11. The ink supply device of claim 1, further comprising a plurality of the ink cartridges and a plurality of the cartridge mounts, wherein each of the ink cartridges is configured to be independently inserted into and removed from a respective one of the ink cartridge mounts.

12. The ink supply device of claim 1, wherein the ink supply device is an inkjet image recording device.

13. The ink supply device of claim 1, wherein when the ink cartridge reaches a fourth position between the second position and the third position, the first projecting member opens the ink valve.

14. The ink supply device of claim 1, wherein the air valve mechanism is located above the ink valve mechanism when the ink cartridge is inserted into the cartridge mount.

15. The ink supply device of claim 1, wherein the cartridge mount comprises an ink level sensor configured to detect an ink amount remaining in the ink chamber, and the ink cartridge further comprises a detected portion disposed between the air valve mechanism and the ink valve mechanism and configured to be detected by the ink level sensor.

16. The ink supply device of claim 1, wherein the further elastic member of the second projecting member comprises a coil spring.

* * * * *